United States Patent [19]

Habegger

[11] 4,050,276

[45] Sept. 27, 1977

[54] THREAD-ROLLING HEAD

[76] Inventor: Harold Habegger, Sous Graitery 10, 2738 Court, Berne, Switzerland

[21] Appl. No.: 753,527

[22] Filed: Dec. 22, 1976

[30] Foreign Application Priority Data

Dec. 23, 1975 Switzerland ..... 16725/75

[51] Int. Cl.[2] ..... B21H 3/04

[52] U.S. Cl. ..... 72/104; 72/121

[58] Field of Search ..... 85/8.6, 8.8, 8.9; 10/89 H, 152 R; 72/103, 104, 123, 121; 408/148; 29/115, 116 R, 121 H

[56] References Cited

U.S. PATENT DOCUMENTS 3,439,518 4/1969 Burnett ..... 72/104

FOREIGN PATENT DOCUMENTS 748,582 11/1944 Germany ..... 85/8.9

*Primary Examiner*—Lowell A. Larson

*Attorney, Agent, or Firm*—McNenny, Pearne, Gordon, Gail, Dickinson & Schiller

[57] ABSTRACT

A thread-rolling head comprises three identical support pieces rotatingly and non-displaceably mounted in a bearing member. Each support piece has at its outer end a supporting journal on which a thread roller is rotatingly disposed between an annular shoulder of the support piece and a circlip which matingly engages a V-shaped annular groove; the side of the groove nearest the thread-roller is a flat shoulder and the other conical side has an outer diameter equal to that of the journal, the outer end face of which is flush with the outer face of the circlip.

1 Claim, 4 Drawing Figures

THREAD-ROLLING HEAD

Figure 1:
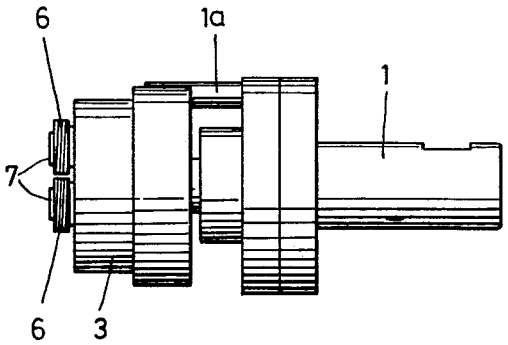

This invention relates to a thread-rolling head of the type wherein three identical support pieces, each including a pivot pin, a supporting journal, and a crank cheek, are rotatingly and non displaceably mounted by means of their pivot pins in three respective bearing bores uniformly distributed in a bearing member about the longitudinal axis of the thread-rolling head, each crank cheek resting against an associated portion of a control surface forming part of a control member rotatable with respect to the bearing member, and each supporting journal being cantilevered and projecting beyond the control member, and wherein each of three thread rollers is rotatingly borne on a supporting surface of an associated supporting journal and is held axially between a shoulder surface of a support piece situated immediately adjacent to a crank cheek and a circlip disposed on the associated supporting journal.

A thread-rolling head of this type is described in U.S. Pat. No. 3,972,213 and represents the point of departure for the present invention. In this previously known design, the circlips transmit from the thread rollers to the supporting journals the entire force required at the time of "opening" of the thread-rolling head, which generally takes place in a fraction of a thousandth of a second, for overcoming (a) the mass moment of inertia of the parts (support pieces, bearing member) which then move together with the thread rollers parallel to the axis thereof, (b) the resistance of a spring acting upon the bearing member, and (c) the frictional forces occurring at the surfaces of the detent means then sliding upon one another.

In contrast thereto, Swiss Pat. No. 394,096 discloses a non-adjustable thread-rolling head wherein a circlip is provided in a fixed support ring for the axial seating of each supporting journal made in one piece with one of the thread rollers.

In the case of a thread-rolling head known, for example, from U.S. Pat. No. 2,651,224, and also in the case of a thread-rolling head disclosed in U.S. Pat. No. 3,196,650, the supporting journals are mounted on the support piece in front and in back of the thread rollers, and parts of the rolling head are situated even in front of the thread rollers. The situation is similar in the thread-rolling head disclosed in U.S. Pat. No. 3,367,159.

It is an object of this invention to provide an improved thread-rolling head of the type initially described wherein that portion of each supporting journal situated in front of the thread rollers is virtually eliminated so that the thread rollers are enabled to work right up to within immediate proximity of a shoulder on a workpiece.

To this end, in the thread-rolling head according to the present invention, the improvement comprises a V-shaped annular groove in each supporting journal for holding a respective circlip, each such groove having a flat side forming a shoulder situated adjacent to a thread roller and a conical side having an outer diameter substantially equal to the diameter of the supporting surface of a the associated supporting journal, each circlip having a conical surface matching and resting against a conical side of an annular groove, and each supporting journal having a flat end face situated flush with the face of each circlip remote from each thread roller.

In view of the aforementioned transmission of force which takes place, as described in connection with the thread-rolling head of U.S. Pat. No. 3,972,213, it is all the more unexpected that the axial seating of the thread rollers according to the present invention, viz., one comprising merely circlips acting upon conical surfaces situated at the outermost ends of the support pieces, is capable of withstanding the resulting stresses, and especially for many hours of operation.

Figure 2:
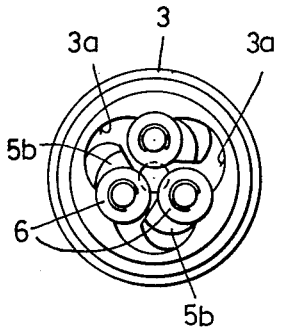
Figure 3:
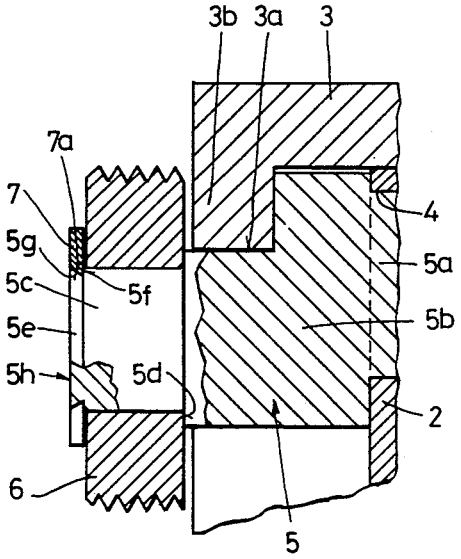
Figure 4:
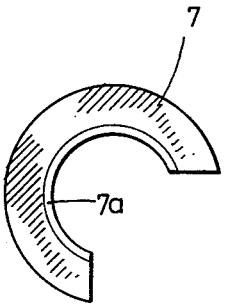

A preferred embodiment of the invention will now be described in detail with reference to the accompanying drawing, in which:

FIGS. 1 and 2 are elevation and an end-on view, respectively, of the thread-rolling head, FIG. 3 is a partial longitudinal section of the thread-rolling head in the region of one of the thread rollers, and FIG. 4 is a front view of one of the circlips.

In the thread-rolling head illustrated in FIGS. 1 and 2, a bearing member 2 is mounted for rotation about the longitudinal axis of the thread-rolling head upon the front end of a support member 1 within a jacket-shaped control member 3 which is non-rotatably braced against a part 1*a* of the support member 1. Pivot pins 5*a* of three identical, crank-like support pieces 5 are rotatingly and non-displaceably mounted in three respective longitudinal bores 4 of the bearing member 2, which are uniformly distributed about the longitudinal axis of the thread-rolling head. Crank cheeks 5*b* of the support pieces 5 rest against the flat front end face of the bearing member 2 and, over the front half of their length, against a control surface 3*a* formed by the inner edge of am inwardly-projecting flange 3*b* situated at the front of the control member 3; the control surface 3*a* is designed in such a way that rotation of the bearing member 2 by about 30° with respect to the control member 3 and the support member 1 causes the thread-rolling head to "open" or "close", as the case may be, by moving supporting journals 5*c* towards or away from the longitudinal axis of the thread-rolling head, respectively.

A thread roller 6 is rotatingly disposed on the supporting journal 5*c* of each of the support pieces 5. In the thread-roller head design described in the aforementioned U.S. Pat. No. 3,972,213, these thread rollers must, at the end of the thread-rolling operation, exert upon the bearing member, via the support pieces, a force directed from right to left, as viewed in the present FIGS. 1 and 3, exerted upon the thread rollers by a workpiece, so that the bearing member may be released from the support member and so that a spring may rotate the bearing member in the direction of "opening" the thread-rolling head with respect to the support member and the control member. In the present embodiment, the rear face (the right-hand face as viewed in FIG. 3) of each thread roller 6 rests against a flat shoulder 5*d* of the associated support piece 5 situated immediately in front of the crank cheek 5*b*. The front face of each thread roller 6 rests against a circlip 7 engaged in an annular groove 5*e* of the respective supporting journal 5*c*. The groove 5*e* is V-shaped, the side 5*f* thereof nearest the thread roller 6 taking the form of a flat shoulder, and the other, conical side 5*g* thereof having an outer diameter substantially equal to that of the supporting surface of the supporting journal 5*c;* a surface 7*a* of the circlip 7 resting against the side 5*g* is matchingly conical. The outer end face 5*h* of the supporting journal 5*c* is flush with the outer face of the circlip 7, which is possible only owing to the design of the annular groove 5*e* and of the circlip 7 as just described. Hence it is obvious that the thread rollers 6 can roll a thread on a workpiece up to extremely close (thickness of the circlips 7) to a shoulder (e.g., a screw-head) of a workpiece.

What is claimed is:

1. In a thread-rolling head of the type wherein three identical support pieces, each including a pivot pin, a supporting journal, and a crank cheek, are rotatingly and non-dispaceably mounted by means of said pivot pins in three respective bearing bores uniformly distributed in a bearing member about the longitudinal axis of said thread-rolling head, each said crank cheek resting against an associated portion of a control surface forming part of a control member rotatable with respect to said bearing member, and each said supporting journal being cantilevered and projecting beyond said control member, and wherein each of three thread rollers is rotatingly borne on a supporting surface of an associated said supporting journal and is held axially between a shoulder surface of a said support piece situated immediately adjacent to a said crank cheek and a circlip disposed on said associated supporting journal, the improvement comprising:

a V-shaped annular groove in each said supporting journal for holding a respective said circlip, each said groove having a flat side forming a shoulder situated adjacent to a said thread roller and a conical side having an outer diameter substantially equal to the diameter of said supporting surface of said associated supporting journal, each said circlip having a conical surface matching and resting against a said conical side of a said annular groove, and each said supporting journal having a flat end face situated flush with the face of each said circlip remote from each said thread roller.

* * * * *